US006729616B2

(12) United States Patent
Chen

(10) Patent No.: US 6,729,616 B2
(45) Date of Patent: May 4, 2004

(54) INTERLOCKED TYPE PAPER COLLECTION SUPPORT BOARD OF PRINTER

(75) Inventor: Biing-Wen Chen, Hsin Chu (TW)

(73) Assignee: Lite-On Technology Corporation, Taipei (TW)

( * ) Notice: Subject to any disclaimer, the term of this patent is extended or adjusted under 35 U.S.C. 154(b) by 33 days.

(21) Appl. No.: 10/197,446

(22) Filed: Jul. 18, 2002

(65) Prior Publication Data

US 2004/0013459 A1 Jan. 22, 2004

(51) Int. Cl.[7] ..... B65H 31/20

(52) U.S. Cl. ..... 271/213; 271/171; 271/207; 399/405

(58) Field of Search ..... 399/405; 271/171, 271/163, 213, 162, 207

(56) References Cited

U.S. PATENT DOCUMENTS

| | | | | | |
|---|---|---|---|---|---|
| 4,985,714 | A | * | 1/1991 | Norris | 221/195 |
| 5,172,903 | A | * | 12/1992 | Haneda et al. | 271/171 |
| 5,175,583 | A | * | 12/1992 | Noh et al. | 399/107 |
| 5,241,353 | A | * | 8/1993 | Maeshima et al. | 399/405 |
| 5,327,206 | A | * | 7/1994 | Ueda et al. | 399/402 |
| 5,711,517 | A | * | 1/1998 | Kelly | 271/4.01 |
| 5,944,308 | A | * | 8/1999 | McLeod et al. | 271/171 |
| 6,053,493 | A | * | 4/2000 | Yokoyama et al. | 271/171 |
| 6,106,178 | A | * | 8/2000 | Chiu | 400/624 |
| 6,231,043 | B1 | * | 5/2001 | James et al. | 271/209 |
| 6,249,295 | B1 | * | 6/2001 | Kiyohara et al. | 346/134 |
| 6,276,852 | B1 | * | 8/2001 | Osmus | 400/624 |
| 6,474,884 | B2 | * | 11/2002 | Chiu | 400/624 |
| 2003/0081101 | A1 | * | 5/2003 | Khormaei et al. | 347/104 |

FOREIGN PATENT DOCUMENTS

| | | | | |
|---|---|---|---|---|
| JP | 4-333462 | * | 11/1992 | 271/213 |
| JP | 6-9066 | * | 1/1994 | 399/405 |
| JP | 2002-226119 | * | 8/2002 | 271/209 |

* cited by examiner

*Primary Examiner*—Donald P. Walsh
*Assistant Examiner*—Daniel K Schlak
(74) *Attorney, Agent, or Firm*—Rosenberg, Klein & Lee

(57) ABSTRACT

An interlocked type paper collection support board of printer includes a paper-out board, an extension board, and a half stroke mechanism. The paper-out board is retractably installed on a main body of a printer. The extension board is also retractably installed on the paper-out board. The half stroke mechanism is installed between the main body of the printer, the paper-out board, and the extension board. Through interlocked motion of the half stroke mechanism, the paper-out board is simultaneously driven when a user draws the extension board. The paper-out board can thus be simultaneously positioned with the extension board with half the speed and displacement of the extension board.

9 Claims, 7 Drawing Sheets

INTERLOCKED TYPE PAPER COLLECTION SUPPORT BOARD OF PRINTER

FIELD OF THE INVENTION

The present invention relates to an interlocked type paper collection support board of printer and, more particularly, to an interlocked type paper collection support board of printer utilizing a half stroke mechanism. The half stroke mechanism comprises a belt and a pulley. Two ends of the belt are fixedly connected at an extension board and a main body of a printer. The pulley is disposed at a paper-out board. The half stroke mechanism can thus synchronously drive the paper-out board with half stroke when the extension board is drawn so that the paper-out board and the extension board can be positioned simultaneously.

BACKGROUND OF THE INVENTION

Presently, commercially available printers have mainly two types of paper collection support boards: single-sheet type and double-sheet combination type.

The single-sheet type paper collection support board is limited by the size of a printer's body. If the hold board has a large area, it cannot be hidden in the printer's body and must be hung outside. Moreover, the hold board must be processed as an accessory when packaging, hence being very cumbersome and inconvenient and increasing packaging cost.

When the double-sheet combination type paper collection support board is retracted, the small sheet is first retracted into the larger sheet, and the larger sheet is then retracted into a printer's body. When in use, the larger sheet is first pulled out, and the smaller sheet is then pulled out (it is necessary to pull twice) so as to achieve an area enough for bearing papers of A4 size. Therefore, the actions of pulling out and retracting back are too cumbersome.

Besides, there is also a fixed joint type paper collection support board adopted by the Hewlett-Packard company. Its drawback is that the volume of the whole machine is too large, resulting in increase of transportation cost.

Most of commercially available printers adopt the double-sheet combination type paper collection support board. However, the above drawback has not been solved, resulting in inconvenience and trouble in use, much less friendly operation. After some times of operation, users will gradually disgust it.

Accordingly, the present invention aims to propose an interlocked type paper collection support board of printer to resolve the problems in the prior art.

SUMMARY OF THE INVENTION

The primary object of the present invention is to provide an interlocked type paper collection support board of printer, whereby it is not necessary to pull the paper collection support board twice or add more actions, thereby creating more friendly use with a single smooth pulling or retraction action.

Another object of the present invention is to provide an interlocked type paper collection support board of printer to avoid increase of packaging and transportation cost.

Another object of the present invention is to provide an interlocked type paper collection support board of printer, wherein tension of a belt is used to replace friction between plastic components as the resistance force when the paper collection support board is pulled out or retracted in. Therefore, an identical draw force can be kept during the action of pulling out or retracting in the paper collection support board. Moreover, the design of belt and pulley can get rid of variation of quality due to large size variation of plastic components.

To achieve the above objects, the present invention provides an interlocked type paper collection support board of printer, which comprises a paper-out board, an extension board, and a half stroke mechanism. The paper-out board is retractably installed on a main body of a printer. The extension board is also retractably installed on the paper-out board. The half stroke mechanism is installed between the main body of the printer, the paper-out board, and the extension board. Through interlocked motion of the half stroke mechanism, the paper-out board is simultaneously driven when a user draws the extension board. The paper-out board can thus be positioned at the same time with the extension board with half the speed and displacement of the extension board. The various objects and advantages of the present invention will be more readily understood from the following detailed description when read in conjunction with the appended drawing, in which:

BRIEF DESCRIPTION OF THE DRAWINGS

FIG. 4 is a bottom view of the present invention when half retracted in;

DETAILED DESCRIPTION OF THE PREFERRED EMBODIMENTS

Figure 1:
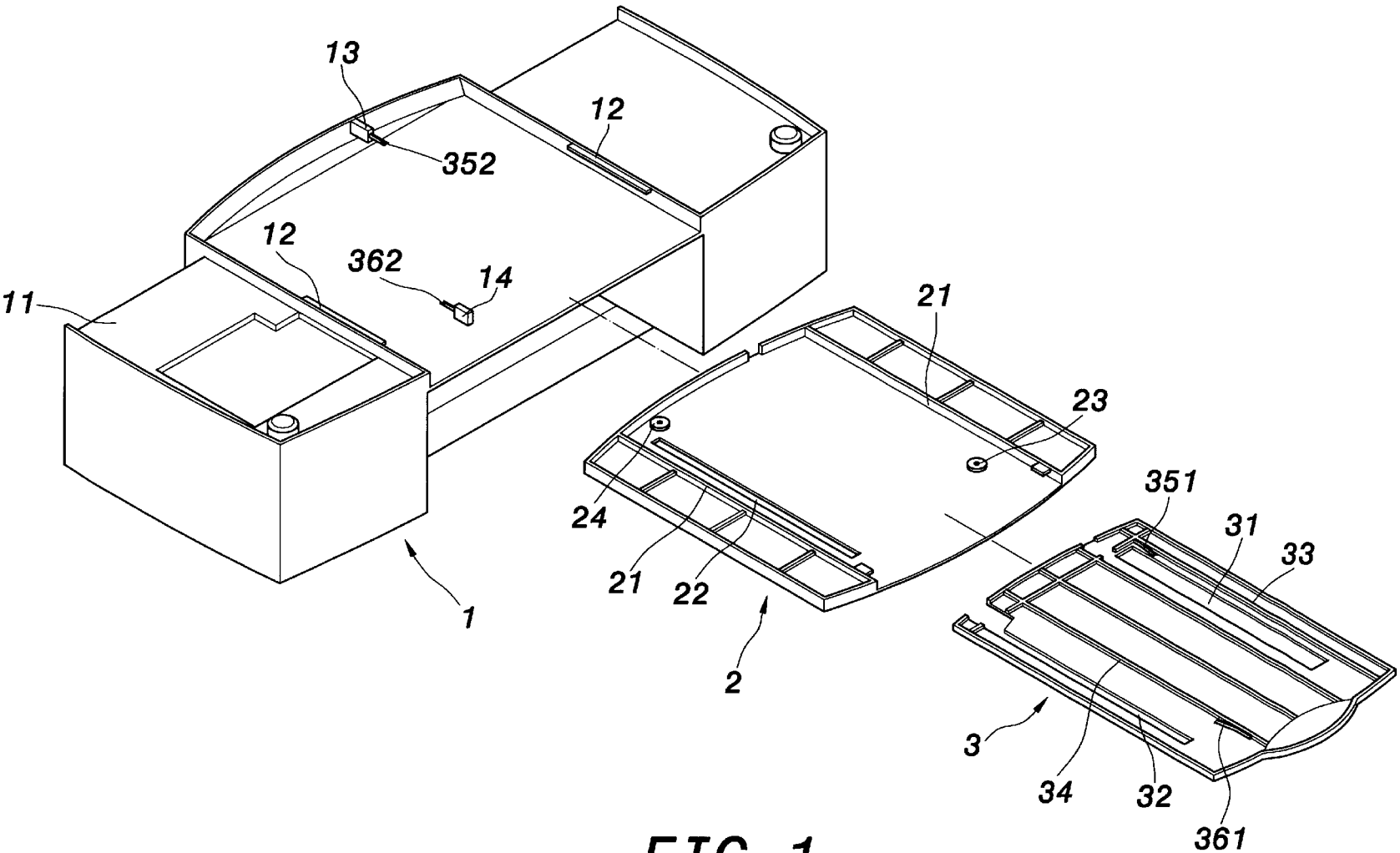
FIG. 1 is an inverse exploded perspective view of the present invention.
Figure 1A:
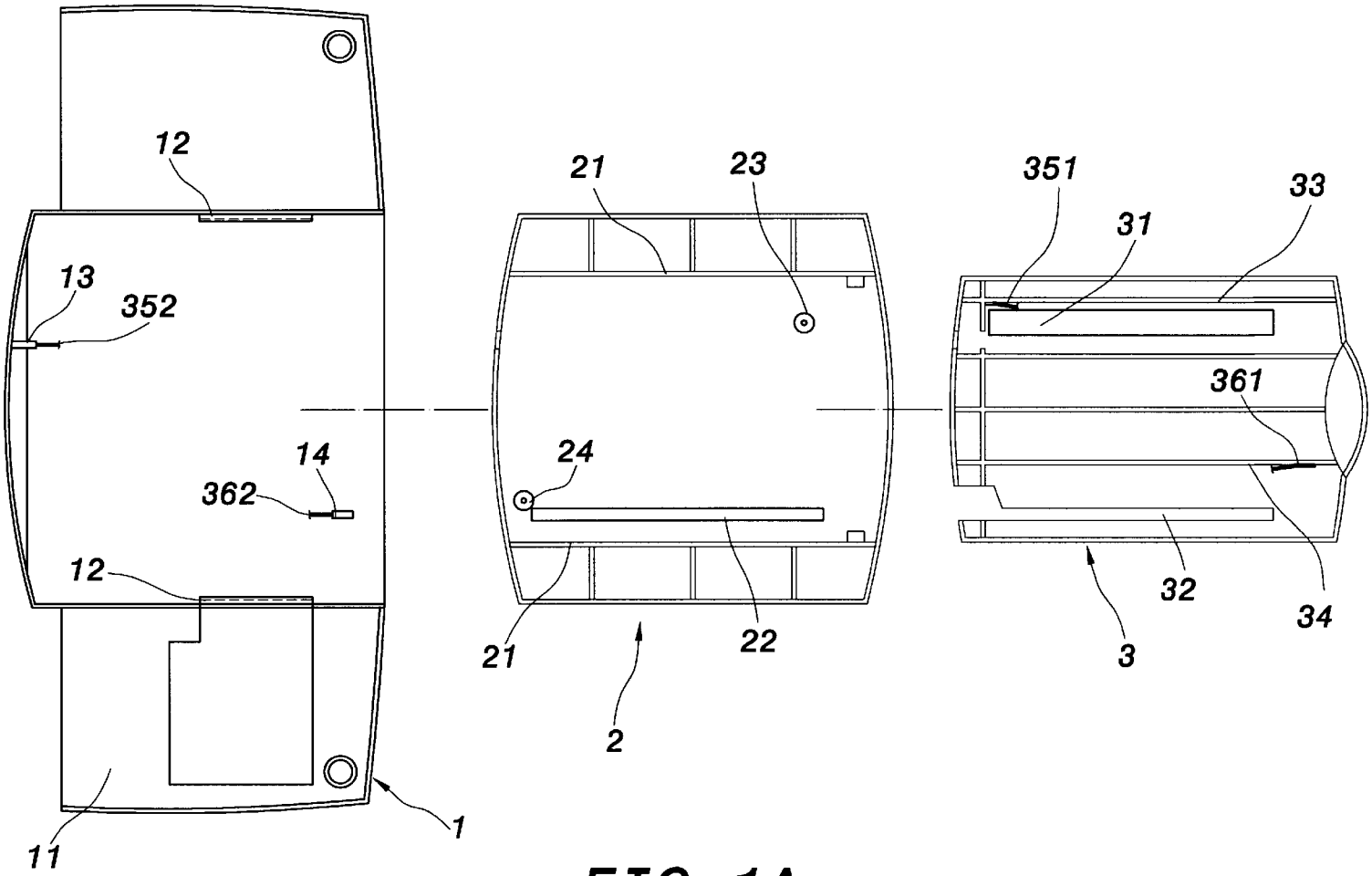
FIG. 1A is an exploded bottom view of the present invention.
Figure 2:
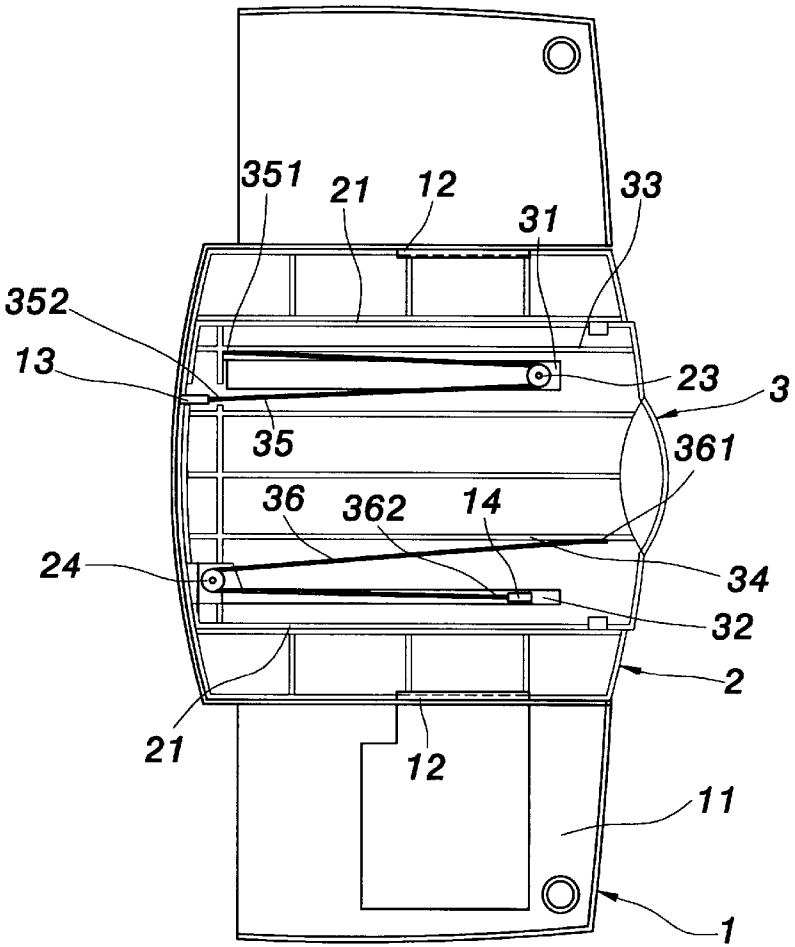
FIG. 2 is a plan assembly view of FIG. 1A.

As shown in FIGS. 1, 1A, and 2, the present invention provides an interlocked type paper collection support board of printer, which comprises a paper-out board 2 and an extension board 3. A half stroke mechanism capable of functioning between a printer's body 1, the paper-out board 2, and the extension board 3 is exploited to jointly drive the paper collection support board.

The paper-out board 2 is installed between two slide tracks 12 of a bottom side 11 of the printer's body 1. The extension board 3 is installed between two slide tracks 21 of the bottom side of the paper-out board 2. The paper-out board 2 can retractably move between the two slide tracks 12 at the bottom side 11 of the printer's body 1. The extension board 3 can also retractably move between the two slide tracks 21 at the bottom side of the paper-out board 2. Matched with the above half stroke mechanism, when a user draws the extension board 3, the paper-out board 2 is simultaneously driven. The paper-out board 2 can thus be positioned at the same time with the extension board 3 with half the speed and displacement of the extension board 3.

Figure 3:
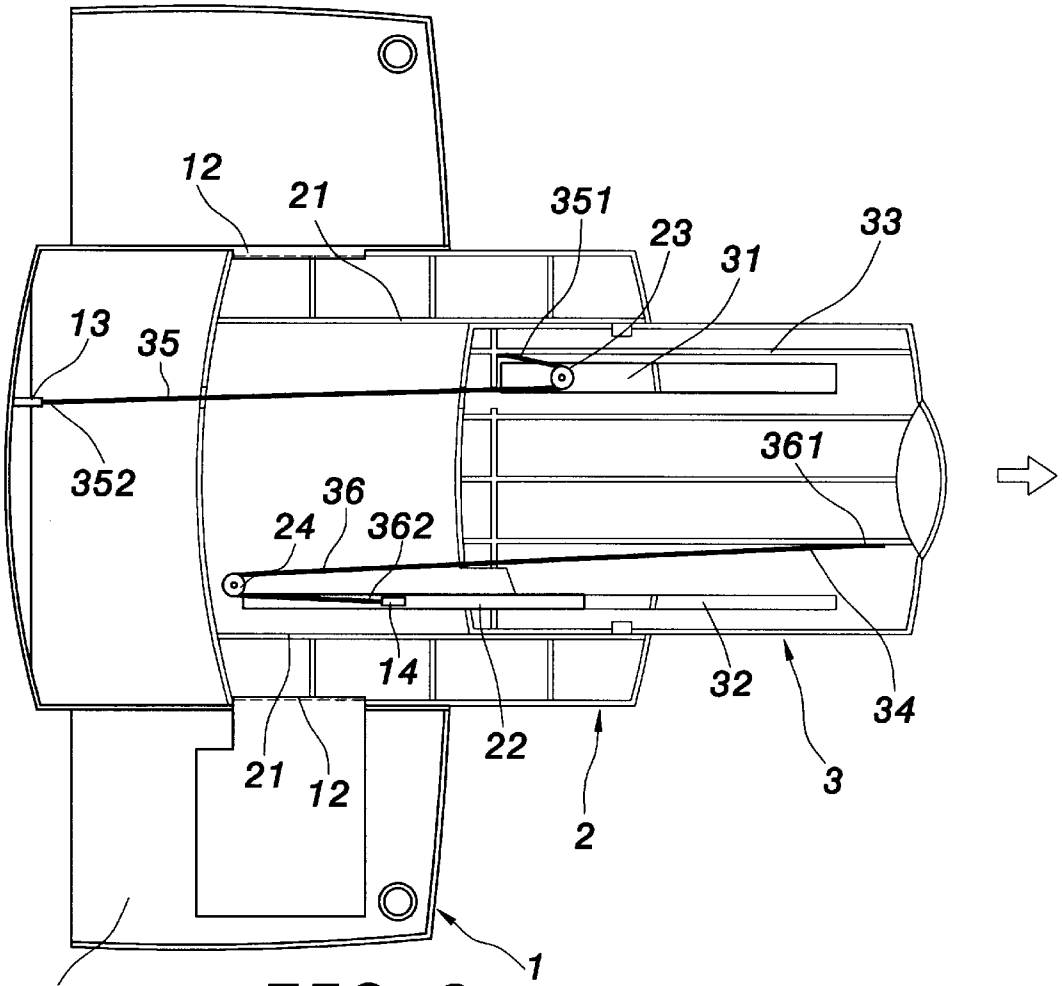
FIG. 3 is a bottom view of the present invention when pulled out.
Figure 4:
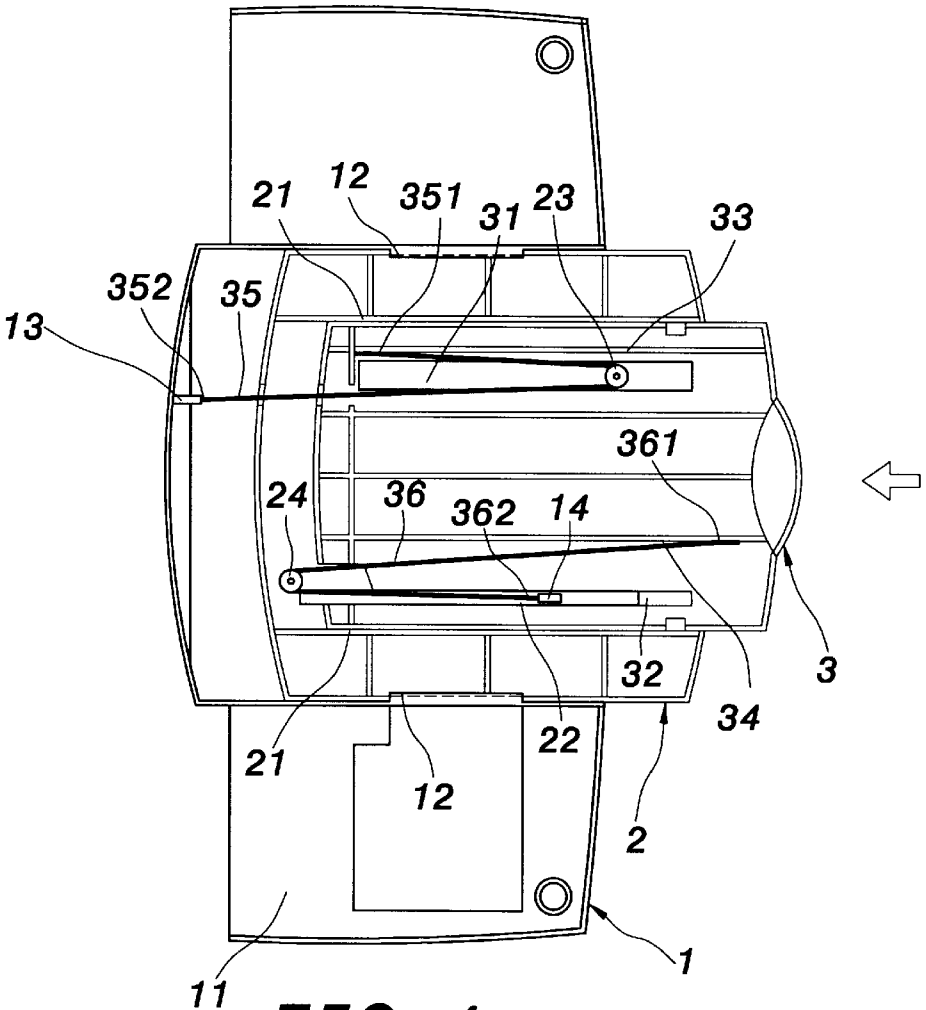
Figure 5:
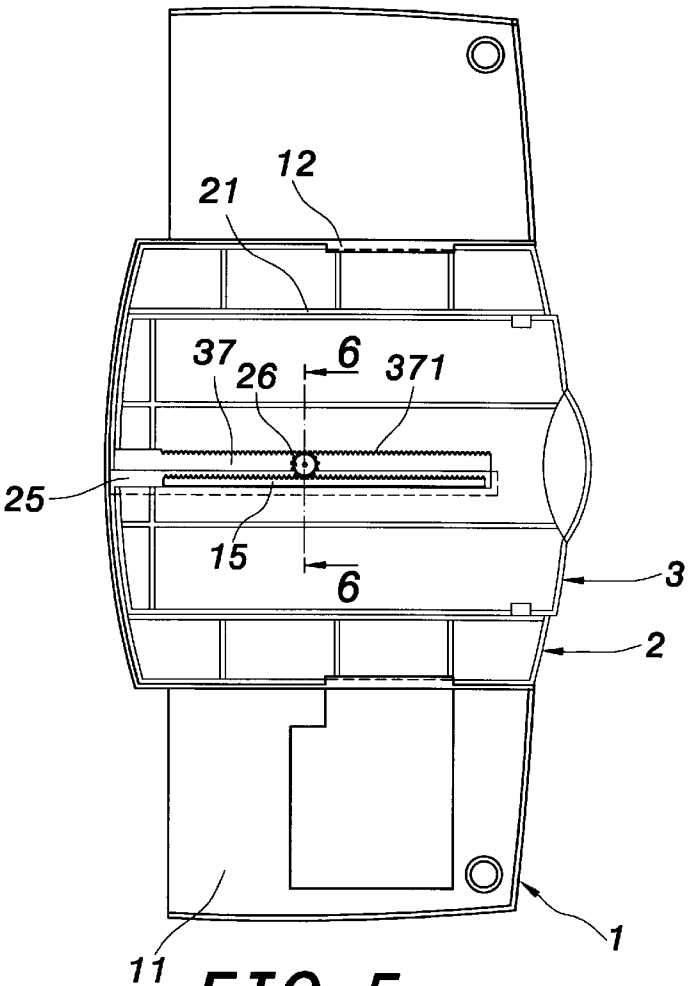
FIG. 5 is a bottom view of another embodiment of the present invention.
Figure 6:
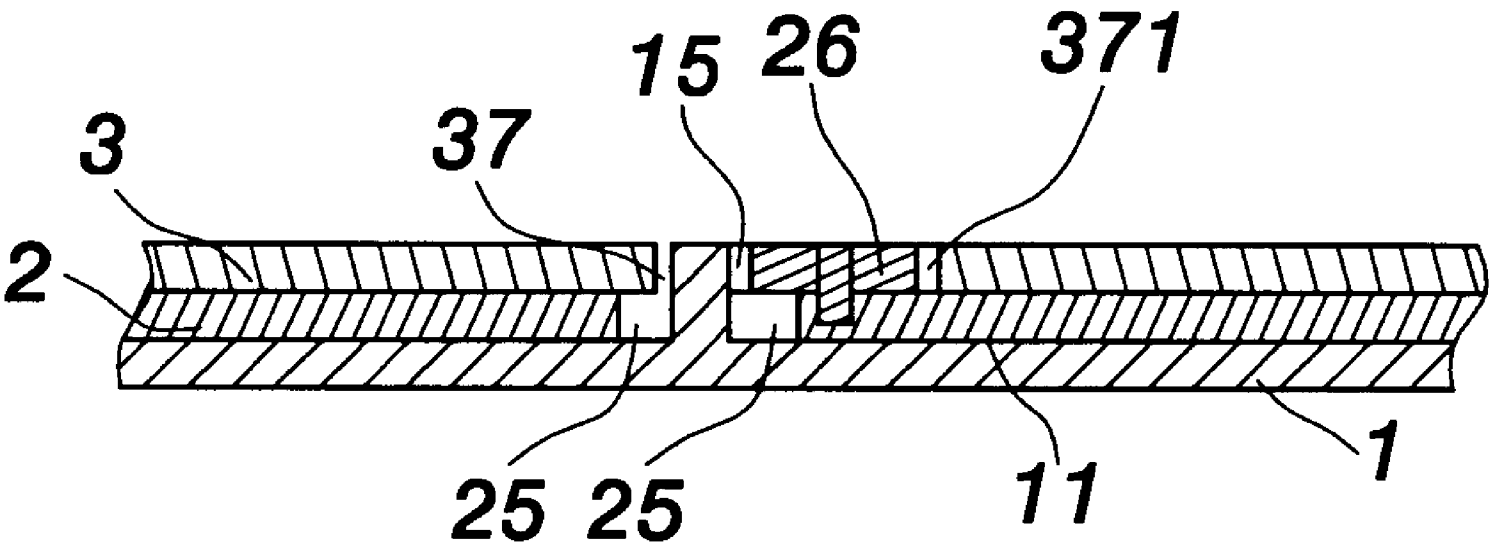
FIG. 6 is a cross-sectional view along line 6—6 in FIG. 5.

There are many kinds of structures capable of accomplishing half stroke for the half stroke mechanism, e.g., the belt type shown in FIGS. 1 to 4 and the rack type shown in FIGS. 5 and 6.

The belt type half stroke mechanism according to a preferred embodiment of the present invention is first illustrated below. As shown in FIGS. 1 and 1A, two fixed joint positions 13 and 14 respectively located at the left-rear and right-front positions between the two slide tracks 12 are preset at the bottom side 11 of the printer's body 1. A second opening 22 is disposed on the paper-out board 2 and located between the two slide tracks 21. Two pulleys are installed between the two slide tracks 21. The one at the left-front corner is the first pulley 23, and the other at the right-rear corner is the second pulley 24. A first opening 31 is disposed on the extension board 3. A slit 32 is disposed at the rear edge of the extension board 3. The bottom side of the extension board 3 has two ribs 33 and 34. As shown in FIGS. 2 and 3, the first opening 31 is opposite to the first pulley 23, and the slit 32 is opposite to the second opening 22 up and down. The second pulley 24 can be exactly received at the rear end of the slit 32.

As shown in FIG. 2, a front end 361 of a second belt 36 is fixedly connected at the front end of the bottom side of the extension board 3 (fixedly connected beside the front end of the rib 34), and is then wound around the second pulley 24 in the counterclockwise direction. Next, a rear end 362 thereof passes through the second opening 22 of the paper-out board 2 and is then fixedly connected at the front end of the bottom side 11 of the printer's body 1, or is fixedly connected at the fixed joint position 14. A front end 351 of a first belt 35 is fixedly connected at the rear end of the bottom side of the extension board 3 (fixedly connected beside the rear end of the rib 33), and is then wound around the first pulley 23 in the clockwise direction. Next, a rear end 352 thereof is fixedly connected at the rear end of the bottom side 11 of the printer's body 1, or is fixedly connected at the fixed joint position 13. Two sets of belt type half stroke mechanisms are thus formed. The first set comprises the first belt 35 and the first pulley 23, and the second set comprises the second belt 36 and the second pulley 24.

As shown in FIGS. 2 and 3, when a user pulls out the extension board 3, the second set half stroke mechanism functions. Assume the speed of the extension board 3 is 2V and the displacement thereof is 2S, the paper-out board will also be led out with in half stroke due to the action of the second set half stroke mechanism. In other words, the speed and displacement of the paper-out board 2 is V and S, respectively (half the speed and displacement of the extension board 3). As shown in FIGS. 3 and 4, when a user retracts in the extension board 3, the first set half stroke mechanism functions, and the paper-out board will be led in with half stroke way. Therefore, regardless of the action of pulling out or retracting in the paper collection support board, through the interlocked motion of the first set or the second set half stroke mechanism, the paper-out board 2 will be driven at the same time when the extension board 3 is drawn. The paper-out board 2 will be simultaneously positioned with the extension board 3 with half the speed and displacement of the extension board 3 relative to the printer's body 1.

Of course, there are many ways of fixedly connecting the front and rear ends (351, 352, 361, 362) of the belts. Beside the way shown in FIG. 3, a way of using clamping tools or a fixedly clamping way (not shown) can also be used. In the fixedly connecting way shown in FIG. 3, the front and rear ends of the belts are sideward connected at the ribs 33 and 34 of the extension board 3, or are connected at the fixedly joint positions 13 and 14 of vertical sheet shape at the bottom side 11 of the printer's body 1.

The rack type half stroke mechanism according to another embodiment of the present invention is first illustrated below. As shown in FIGS. 5 and 6, the rack type half stroke mechanism comprises a first rack 371, a second rack 15, and a gear 26. The gear 26 is disposed at the bottom side of the paper-out board 2. A first slit 37 with a broken rear edge is formed at the position where the extension board 3 corresponds to the gear 26. The first rack 371 is formed at a long side at the inner edge of the first slit 37. The second rack 15 protrudes out of the bottom side 11 of the printer's body 1. A second slit 25 having a broken rear edge is formed at the position where the paper-out board 2 corresponds to the second rack 15 so that the second rack 15 can be exposed out of the second slit 25. The first and second slits 37 and 25 partly overlap up and down so that the second rack 15 can be exposed in the first slit 37 of the extension board 3, and the first and second racks 371 and 15 are opposite to each other with the gear 26 engaged between them. The rack type half stroke mechanism can also accomplish the same functions as the belt type.

To sum up, in the present invention, a half stroke mechanism is matched between the printer's body 1, a paper-out board 2, and an extension board 3. Through interlocked motion of the half stroke mechanism, the paper-out board 2 is simultaneously driven when a user draws the extension board 3. The paper-out board 2 can thus be simultaneously positioned with the extension board 3 with half the speed and displacement of the extension board 3. Therefore, the pulling out or retracting in action of the paper collection support board is smooth and simple without the need of pulling out or retracting in twice. Because the paper-out board 2 moves along with the extension board 3 with half the speed and displacement of the extension board 3, a friendly operation can be created. Moreover, the paper collection support board can be hidden in the printer's body 1 and needs not to be hung outside so as to avoid increase of the packaging and transportation cost, hence controlling the cost. Furthermore, tension of belt is used to replace friction between plastic components as the resistance force when the paper collection support board is pulled out or retracted in. Therefore, an identical draw force can be kept during the action of pulling out or retracting in. Moreover, design of belt and pulley can get rid of variation of quality due to large size variation of plastic components.

Although the present invention has been described with reference to the preferred embodiment thereof, it will be understood that the invention is not limited to the details thereof. Various substitutions and modifications have been suggested in the foregoing description, and other will occur to those of ordinary skill in the art. Therefore, all such substitutions and modifications are intended to be embraced within the scope of the invention as defined in the appended claims.

I claim:

1. An interlocked type paper collection support board of printer, comprising:

a paper-out board retractably installed on a printer's body; an extension board retractably installed on said paper-out board; and a half stroke mechanism installed among said printer's body, said paper-out board, and said extension board;

whereby, through interlocked motion of said half stroke mechanism, said paper-out board is simultaneously driven when a user draws said extension board, and said paper-out board is simultaneously positioned with said extension board with half the speed and displacement of said extension board;

wherein said half stroke mechanism comprises a belt and a pulley.

2. The interlocked type paper collection support board of printer as claimed in claim 1, wherein there are two sets of said half stroke mechanism respectively comprising a first belt and a first pulley and a second belt and a second pulley, the two sets of said half stroke mechanism are parallel arranged, said first and second pulley are disposed on said paper-out board, and two ends of said first and second belts wound around said pulleys respectively in the clockwise and counterclockwise directions are fixedly connected between said extension board and said printer's body.

3. The interlocked type paper collection support board of printer as claimed in claim 2, wherein said paper-out board is slidably disposed at a bottom side of said printer's body, and said extension board is slidably disposed at a bottom side of said paper-out board.

4. The interlocked type paper collection support board of printer as claimed in claim 3, wherein said first pulley is disposed near a front corner of the bottom side of said extension board, said second pulley is disposed near a rear corner of the bottom side of said paper-out board, a first opening is formed on said extension board at a position corresponding to said first pulley, a rear end of said second belt wound around said second pulley is fixedly connected at the bottom side of said printer's body, a slit with a broken rear edge and a second opening are formed at positions where said extension board and said paper-out board correspond to the rear end of said second belt, respectively.

5. The interlocked type paper collection support board of printer as claimed in claim 4, wherein a front end of said second belt is fixedly connected at a front end of the bottom side of said extension board and is then wound around said second pulley in the counterclockwise direction, a rear end of said second belt passes though said second opening of said paper-out board and is then fixedly connected at a front end of the bottom side of said printer's body, a front end of said first belt is fixedly connected at a rear end of the bottom side of said extension board and is then wound around said first pulley in the clockwise direction, and a rear end of said first belt is fixedly connected at a rear end of the bottom side of said printer's body.

6. An interlocked type paper collection support board of printer, comprising:

a paper-out board retractably installed on a printer's body; an extension board retractably installed on said paper-out board; and a half stroke mechanism installed among said printer's body, said paper-out board, and said extension board;

whereby, through interlocked motion of said half stroke mechanism, said paper-out board is simultaneously driven when a user draws said extension board, and said paper-out board is simultaneously positioned with said extension board with half the speed and displacement of said extension board;

wherein said half stroke mechanism comprises a rack and a gear.

7. The interlocked type paper collection support board of printer as claimed in claim 6, wherein said gear is disposed on said paper-out board, said rack comprises a first rack and a second rack, said first and second racks are opposite to each other and formed on said extension board and said printer's body, respectively, and said gear is engaged between said first and second racks.

8. The interlocked type paper collection support board of printer as claimed in claim 7, wherein said paper-out board is slidably disposed at a bottom side of said printer's body, and said extension board is slidably disposed at a bottom side of said paper-out board.

9. The interlocked type paper collection support board of printer as claimed in claim 8, wherein said gear is disposed at the bottom side of said paper-out board, a first slit with a broken rear edge is formed at a position where said extension board corresponds to said gear, said first rack is formed at a long side of an inner edge of said first slit, said second rack protrudes out of the bottom side of said printer's body, a second slit with a broken rear edge is formed at a position where said paper-out board corresponds to said second rack, said second rack protrudes out of said second slit.

* * * * *